United States Patent [19]

Misera et al.

[11] Patent Number: 4,589,468

[45] Date of Patent: May 20, 1986

[54] CONTINUOUS MOLD FOR A CONTINUOUS CASTING PLANT

[75] Inventors: Erich Misera, Asten; Hubert Floh, Hattmannsdorf; Reinhard Haargassner, Linz, all of Austria

[73] Assignee: Voest-Alpine International Corporation, New York, N.Y.

[21] Appl. No.: 547,720

[22] Filed: Nov. 1, 1983

[30] Foreign Application Priority Data

Nov. 4, 1982 [AT] Austria ..... 4023/82
Apr. 13, 1983 [AT] Austria ..... 1320/83

[51] Int. Cl.[4] ..... B22D 11/00
[52] U.S. Cl. ..... 164/418; 164/138
[58] Field of Search ..... 164/418, 138

[56] References Cited

U.S. PATENT DOCUMENTS

| | | | |
|---|---|---|---|
| 3,349,836 | 9/1965 | Rossi | 164/418 |
| 3,809,148 | 3/1974 | Pulsifer | 164/138 X |
| 4,037,646 | 7/1977 | Hara et al. | 164/459 X |
| 4,171,233 | 10/1979 | Vander Voort | 75/123 J X |

FOREIGN PATENT DOCUMENTS

| | | | |
|---|---|---|---|
| 8224826 | 12/1962 | Austria . | |
| 322756 | 6/1975 | Austria . | |
| 360684 | 1/1981 | Austria . | |
| 1028298 | 10/1958 | Fed. Rep. of Germany . | |
| 2625914 | 12/1976 | Fed. Rep. of Germany . | |
| 2838296 | 3/1979 | Fed. Rep. of Germany . | |
| 2822004 | 11/1979 | Fed. Rep. of Germany . | |
| 52-30129 | 7/1973 | Japan | 164/418 |
| 52-43726 | 4/1977 | Japan | 164/418 |
| 5722852 | 7/1980 | Japan | 164/138 |
| 57-32850 | 2/1982 | Japan | 164/138 |
| 57-68248 | 4/1982 | Japan | 164/138 |
| 2108025 | 5/1983 | United Kingdom | 164/138 |
| 880615 | 9/1981 | U.S.S.R. | 164/418 |

*Primary Examiner*—Nicholas P. Godici
*Assistant Examiner*—G. M. Reid
*Attorney, Agent, or Firm*—Horst M. Kasper

[57] ABSTRACT

A continuous mold for a continuous casting plant comprises inner walls made from copper and/or an alloy of copper and a wear resistant and abrasion resistant layer disposed on the copper and/or copper alloy on the inner exposed side of the mold. The layer covers at most two fifths of the total surface of a side wall and reaches from the output end of the mold up to about one third of the length of the mold at the center of the respect side of the mold. The wear resistant layer reaches in the area of the inner edges of the mold from the output end of the continuous mold to at least about the same level as the layer at the center of the respective side wall and up to the input end of the mold. The wear resistant layer can be provided as an open net like a grid or as a grate on the inner wall of the continuous mold with the surface areas in the open parts in between being formed by copper and/or a copper alloy. The geometrical construction of the wear resistant layer allows to employ wear resistant layers of substantial thickness without interfering with the heat transfer to the mold.

25 Claims, 9 Drawing Figures

CONTINUOUS MOLD FOR A CONTINUOUS CASTING PLANT

BACKGROUND OF THE INVENTION

1. Field of the Invention

The present invention relates to a continuous mold for a continuous casting plant and in particular for a continuous steel casting plant, where the inner walls of the mold are constructed of copper and/or of a copper alloy, and where the inner walls are provided with a wear resistant layer at its inside toward the mold hollow space.

It is known to provide the inner walls of a mold with wear resistant layers such as for example by way of explosion plating, electrolytical application, or by spraying. These known molds are provided with wear resistant layers covering the complete extension of the side walls, compare for example German Patent Applications Laid Open De-Os No. 2,625,914, DE-OS No. 2,838,296, DE-OS No. 2,822,004; Austrian Patents At-PS No. 322,756, AT-PS No. 360,684 and German Patent Application Laid Out DE-AS No. 1,284,051. These references concern continuous casting molds where the copper walls are provided with a material which is of a different chemical composition as compared with the mold base material. It is further known from Austrian Pat. No. 322,756 that the material deposed on the base material of the mold extends only over part of the mold. The German Patent Application Laid Open DE-AS No. 2,625,914 teaches a mold where the side walls at least in part provide a first and second layer, which are more wear resistant than the forms themselves. In general, in these known molds the heat transfer between the melt or, respectively, the casting shell and the inner walls of the mold covered with wear resistant material is disadvantageously affected.

In order to avoid affecting the heat transfer too much, the thickness of the wear resistant layer has been kept as low as possible and it was always kept to less than 1.5 millimeters. In case the wear resistant layer is applied onto the inside walls of the mold by electrolytic deposition then the layer thickness is kept even lower since the electrolytic process is an expensive procedure and the layer thickness amounts to at most a few tenths of a millimeter. This results in a further disadvantage as it has been found that a shape deviation of at least about 2 millimeters of the mold side walls begins to seriously affect the quality of the continuously cast material, such that one had to replace the wear resistant layer before the reaching of the maximum allowable deviation in the shape of the form, that is at the point where the thin wear resistant layer had been used up.

It is also known to furnish the inner walls of the mold with a very thin coating such as a chromium plating applied because of metallurgical reasons. Such a layer does not serve as a wear resistant layer since it is worked off by the casting shell within a short time. The purpose of this layer is to protect the melt from picking up copper from the walls of the mold.

The application of a wear resistant layer onto a mold inner wall always results in straining of the inner walls of the mold, which requires countersteps to be taken.

SUMMARY OF THE INVENTION

1. Purposes of the Invention

It is an object of the invention to provide for a mold which avoids the disadvantages and problems associated with conventional continuous molds, and to avoid despite a relatively thick applied layer of wear resistant material a considerable degradation of the heat transfer from the casting material to the side walls as compared with an uncovered continuous mold, and which mold can be produced economically despite a relatively thick wear resistant layer.

It is another object of the present invention to provide a mold with a wear resistant layer on the inner side walls, where the distortions and strains caused by the wear resistant layer are kept low.

It is a further object of the invention to provide an optimal surface strengthening of a continuous mold versus the melt and, respectively, the cast material without degrading the heat transfer.

These and other objects and advantages of the present invention will become evident from the description which follows.

2. Brief Description of the Invention

According to one aspect, the present invention provides a continuous mold for a continuous casting plant which comprises inner walls made from copper and/or an alloy of copper, and a wear resistant layer disposed on the copper and/or alloy of copper on the exposed side of the mold and which layer covers at most two fifths of the total surface of a side wall and which reaches from the output end of the continuous mold up to about one third of the length of the mold at the center of the respective side of the mold and which wear resistant layer reaches in the area of the inner edges of the mold from the output end of the continuous mold to at least about the same level as the layer at the center of the respective side and up to the input end of the mold.

The wear resistant layer can be formed as a substantially concave curve between from about a semicircle to a U-shape running from the side regions to the middle region of an inner wall. The wear resistant layer can comprise martensitic steel alloyed with chromium and molybdenum. The wear resistant layer can have a composition of from about 0.1 to 1.5 weight percent carbon, from about 2 to 20 weight percent chromium, from about 0.5 to 15 weight percent molybdenum, up to about 5 weight percent tungsten, up to about 5 weight percent vanadium, and up to about 5 weight percent niobium, with the balance being iron and impurities resulting from the melting process.

An intermediate layer can be disposed between the wear resistant layer and the inner wall and placed on the inner wall of the mold by deposit welding and the wear resistant layer is placed on the intermediate layer by deposit welding with a layer thickness of from about 3 to 10 millimeter. The intermediate layer preferably comprises from about 1 to 5 weight percent manganese, from about 0.5 to 1.5 weight percent silicon, from about 20 to 50 weight percent copper, up to about 5 weight percent niobium, up to about 5 weight percent iron, up to about 5 weight percent titanium with the balance being nickel and impurities caused by the melting step. The provision of an intermediate layer results in a good mechanical attachment and adhesion between the wear resistant layer and the inner walls of the continuous casting mold.

The wear resistant layer can be brazed immediately to the inner wall of the mold without an intermediate layer. This allows to provide a good mechanical connection of the wear resistant layer to the copper containing inner walls of the continuous casting mold despite the elimination of the intermediate layer.

The wear resistant layer preferably covers not more than one fifth of the total inside wall surface of a side wall of the continuous casting mold. The wear resistant layer can be provided as an open grid on the inner wall of the continuous mold with the surface areas in the open parts of the net being formed by copper and/or copper alloy. The projection form of the deposited materials can have various shapes, which can be represented as a grid, a net or a grate. The expression grid will be used in the following to express this situation. The wear resistant layer is preferably provided as a grid and the grid is provided by parallelepipeds, by equidistant grid rods disposed at right angles, or by honeycomb sections. The distance of the grid rods can be from about 10 to 100 millimeter and is preferably from about 30 to 60 millimeter.

The wear resistant layer can be formed by wear resistant line elements at the wall surface where at least about three fifths of the line elements are inclined relative to the axis of the continuous mold. The inclination angle of at least two thirds of the wear resistant line elements can be from about 30 to 60 degree versus the axis of the continuous mold. The ratio of the distance between two wear resistant line elements to the surface width of a wear resistant line element is preferably from about 3 to 5.

It is more preferred, if the surface of the wear resistant layer is not more than one tenth of a respective inner wall surface of the continuous casting mold. Grooves can be provided in the wall of the continuous casting mold into which the wear resistant layer is pressed. Helically threaded fasteners can be provided as a solid connection between the wear resistant layer and the wall of the mold. The wear resistant layer can be at least 2 millimeter thick, it is preferably thicker than 3 millimeter and more preferred the thickness is at least about 5 millimeter.

According to another aspect, the present invention provides a method for surface strengthening of the inner walls of a continuous mold for a continuous casting plant which comprises providing recesses in the inner walls of continuous mold for a wear resistant layer disposed on the exposed side of the mold and which layer covers at most two fifths of the total surface of a side wall and which reaches from the output end of the continuous mold up to about one third of the length of the mold at the center of the respective side of the mold and which wear resistant layer reaches in the area of the inner edges of the mold from the output end of the continuous mold to at least about the same level as the layer at the center of the respective side and up to the input end of the mold, inserting wear resistant element into the recesses, and solidly connecting the wear resistant elements to the side wall of the continuous mold.

The wear resistant layer can form a gird which in turn is pressed into the corresponding recesses in the inner wall of the continuous mold. The wear resistant layer can be held to the wall by helically threaded fastener elements positioned from the rear side of the inner walls. The wear resistant layer is preferably brazed to the inner side wall of the continuous mold. An intermediate layer of a copper-nickel alloy can be placed by deposit welding into a recess of the inner wall of the continuous casting mold, and a wear resistant layer can be placed onto the intermediate layer with a thickness of from about 3 to 10 millimeters.

Accordingly, the invention provides that the region, where the largest heat transfer occurs, that is the region between the casting mirror and the first lifting off of the casting shell from the inner walls of the continuous mold, is free from the wear resistant layer such that the heat transfer in this region runs just as with conventional continuous casting molds without a wear resistant layer. It has been found that despite the furnishing of a wear resistant layer only in the output region of the continuous casting mold that the wear on the remaining walls of the mold is reduced substantially, since it was found that the wear starts at the output side edges of the mold side walls. In other words, the wear starts at the outside end of the continuous casting mold and runs to the casting mirror, that is to the input end of the mold. Surprisingly, by stopping the start of the wear at the output end of the continuous casting mold there results a also a considerable decrease in the wear at the unprotected inner wall parts disposed closer to the input end of the continuous casting mold.

It is a particular advantage for the narrow wall sides of continuous casting molds with slab size molds if the wear resistant layer is formed from the side regions of the inner wall according to a substantially concave curve, which may have the shape of a semicircle or a U-shape.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
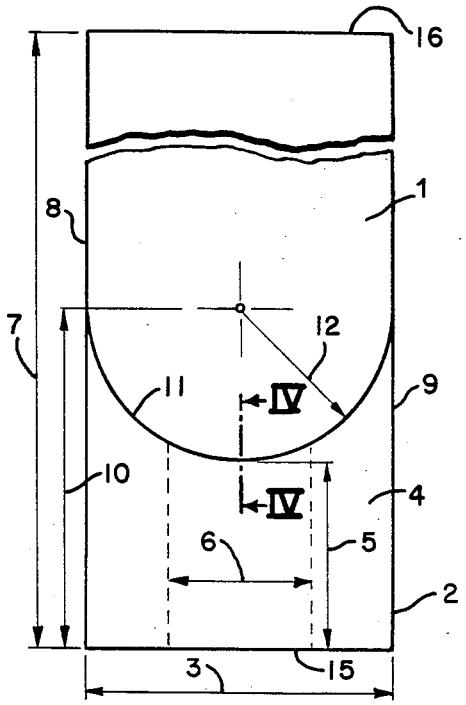
FIG. 1 is a schematic view of a narrow side wall of a slab continuous casting mold according to a first embodiment.

In accordance with the present invention there is provided a continuous casting mold for a continuous casting plant and more particular for a continuous casting steel plant having inside walls 1, 17 of copper or of a copper alloy, where the inner walls 1, 17 are provided at their side disposed toward the hollow space of the mold with a wear resistant layer 4. The wear resistant layer 4 can extend from the output end 15 of the mold to at most over a third of the length 7 of the mold in the middle region 6 of the inner walls 1, 17 of the mold and the side regions 8, 9 of the inner walls 1, 16, supporting the edges of the slab or billet, extend over at least about the length 5 of the wear resistant layer 4 in the middle region 6 up to at most the total length 7 of the continuous casting mold.

The wear resistant layer can run from the side regions 8, 9 of the inner wall to the middle region 6 according to a substantially concave curve 11, which can have the form of a semicircle, of a U-shape, of a polygon or of a triangle. The wear resistant layer can be provided from martensitic steel containing chromium and molybdenum. The composition of the wear resistant layer 4 can be from about 0.1 to 1.5 weight percent carbon, from about 2 to 20 weight percent chromium, from about 0.5 to 15 weight percent molybdenum, up to about 5 weight percent tungsten, up to about 5 weight percent niobium, up to about 5 weight percent vanadium with the remainder being iron and impurities resulting from the melting process.

An intermediate layer 14 of a nickel copper alloy can be disposed between the wear resistant layer 4 and the inner wall 1, 17, which intermediate layer is placed by deposit welding on the inner wall of the mold and the wear resistant layer is also applied by deposit welding on the intermediate layer with a thickness of from about 3 to 10 millimeter. The intermediate layer 14 can contain 1 to 5 weight percent manganese, 0.5 to 1.5 weight percent silicon, 20 to 50 weight percent copper, up to about 5 weight percent niobium, up to about 5 weight percent titanium, up to 5 weight percent iron with the remainder being nickel and impurities resulting from the melting process. Alternatively, the wear resistant layer 4 can be attached immediately to the inner wall 1, 17 without an intermediate layer by brazing.

Preferably, the wear resistant layer 24 is provided as a grid, where the surface area regions of the side walls disposed between the grid bar lines 30 of the wear resistant layer 24 are consisting of the base material of the inner walls 21, 39, which is copper and/or a copper alloy. The grid bar lines 30 can be inclined versus the vertical axis 31 of the mold, and preferably the inclination angle 32 is between about 30 and 60 degree. The ratio of the distance 33 between two grid bar lines 30 to the width 14 of a grid bar line 30 can be from about 3 to 5. The grid like wear resistant layer 4 can be formed from grid rods 30 disposed at right angles relative to each other and having equal distances from each other.

Preferably, the inner wall 21, 39 is provided with grid like disposed grooves 27, the rods 30 of the wear resistant layer 24 form a grid, and this grid is pressed into the grooves 27 of the inner wall 21, 39. The grid disposed in the grooves can be secured by way of screws from the rear side of the inner walls 21, 39.

The narrow side wall 1 of a continuous casting mold provided with internal cooling is manufactured from copper or from a copper alloy. A wear resistant layer 4 extending over the full width 3 is provided at the output region 2 of this narrow side wall. This wear resistant layer 4 extends over a length 5 of the mold with about 200 millimeter in the middle region 6 of the side wall. The total length 7 of the narrow side wall amounts to 900 millimeter.

The wear resistant layer extends over a larger length 10 as measured from the end in the side regions 8,9 of the narrow side wall 1 supporting the edge of the continuous cast billet (corresponding to a corner of the cross-section of the continuous mold), and according to the present embodiment over a length of 250 millimeter. The total width 3 of the side wall 1 amounts to about 210 millimeter. The limiting curve of the wear resistant layer is a concave curve 11, and in fact this curve is of semicircular shape, where the radius 12 corresponds to about half the width 3 of the wall side.

Figure 4:
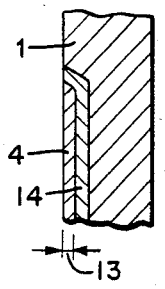
FIG. 4 is a schematic sectional view of the first embodiment along section line IV—IV.

As shown in FIG. 4 there can be applied two layers to the wall: an outer wear resistant layer 4 and an intermediate layer 14 providing adhesion between the wear resistant layer and the base wall material. The wear resistant layer of the embodiment provides the following analytical composition: 0.9 weight percent carbon, 4.0 weight percent chromium, 9.5 weight percent molybdenum, 2.2 weight percent tungsten, 2.0 weight percent vanadium, the remainder iron as well as impurities resulting from the melting step. The wear resistant layer has a thickness 13 of about 5 millimeter. The intermediate layer 14 disposed on the narrow side wall 1 is of the following analyticval composition: 0.02 weight percent carbon, 2.4 weight percent manganese, 0.75 weight percent silicon, 30.0 weight percent copper, 1 weight percent niobium, 1 weight percent iron, 0.25 weight percent titanium, with the remainder being nickel and impurities introduced during the melting stage.

The two layers, both the intermediate layer 14 as well as the wear resistant layer 4 are applied by deposit welding. The hardness of the wear resistant layer 4 amounts to 55 to 60 Rockwell Hardness according to the C scale.

Figure 2:
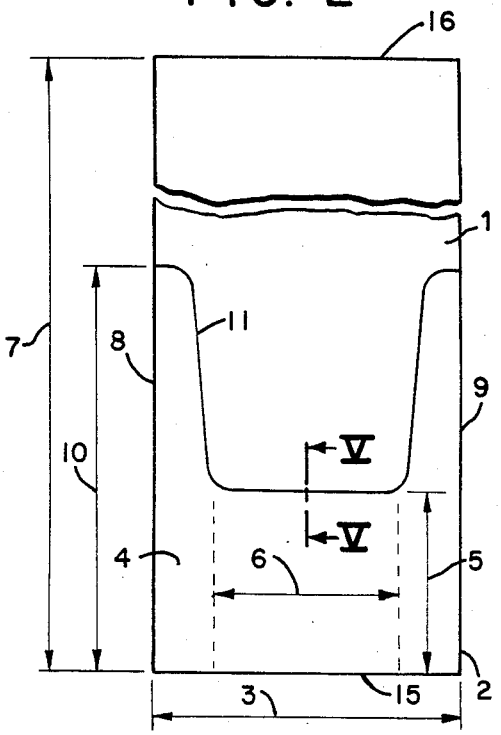
FIG. 2 is a schematic view of a narrow side wall of a slab continuous casting mold according to a second embodiment.

The wear resistant layer 4 extends in the middle region 6 of the narrow side wall 1 with a width of 100 millimeter also over a length 5 of about 200 millimeter as measured from the output side end 15 of the narrow side wall as shown in the embodiment of FIG. 2.

The wear resistant layer 4 extends at the side regions 8, 9 of the narrow side wall 1 supporting the edge regions of the billet over a length 10 of at least 250 millimeter. It is advantageous to run the wear resistant layer up to the end 16 of the narrow side wall on the input side in these side regions 8, 9. The width 3 of the narrow side wall is about 210 millimeter.

The contour 11 of the wear resistant layer looks like a U-shape when looking onto the narrow side wall 1.

Figure 5:
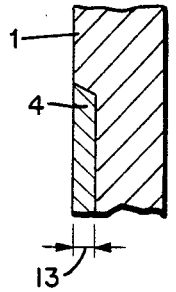
FIG. 5 is a schematic sectional view of the second embodiment along section line V—V.

As can be recognized from the sectional view of FIG. 5, the wear resistant layer 4 is here directly applied to the copper part of the narrow side wall 1, that is no intermediate layer 14 is provided, and brazing was selected as the method for attachment. The chemical composition of the wear resistant layer 4 corresponds approximately to that of the wear resistant layer of FIG. 1.

Figure 3:
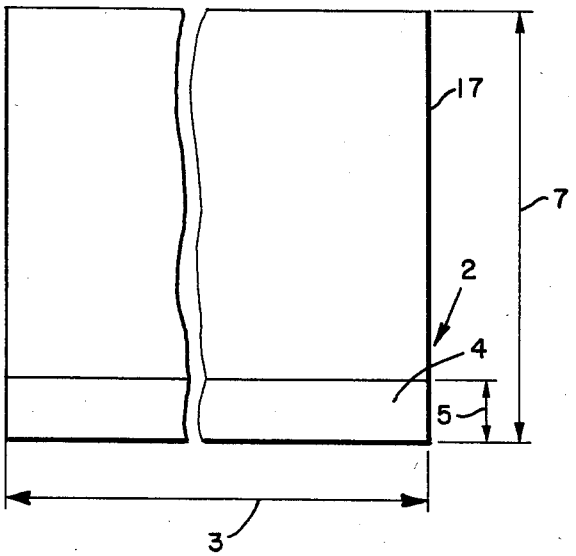
FIG. 3 is a schematic view of a wide side wall of a slab continuous casting mold.

The wear of the wide side walls 17 as compared to the wear of narrow side walls is substantially smaller at continuous casting molds with slab cross-sectional shape. However, nevertheless the wide side walls can be provided with a wear resistant layer 4, where this wear resistant layer 4 again is only disposed in the output region 2 of the wide side wall, as is shown in FIG. 3. The wear resistant layer according to FIG. 3 is disposed about a length 5 of 100 millimeter over the full width 3, where the length 7 of the continuous casting mold is about 900 millimeter and the width 23 of the wide side wall is about 1750 millimeter.

Referring now to FIGS. 6 to 9, here again the narrow side wall 21 is made from copper or from a copper alloy. A gridlike wear resistant layer 24 is provided extending over the full width 23 at the output region 22 of this narrow side wall. The grid shaped layer 24 extends over a length 25 of the continuous casting mold of about 300 millimeters. The total length of the narrow side walls is 900 millimeters. This wear resistant layer advantageously comprises a martensitic steel of the following composition containing chromium and molydenum: 0.1 to 1.5 weight percent carbon, 2 to 20 weight percent chromium, 0.5 to 15 weight percent molybdenum, possibly up to 5 weight percent tungsten, up to 5 weight percent vanadium, up to 5 weight percent niobium with the balance being iron and impurities introduced during the melting step.

The provision of a wear resistant layer is provided as follows: First the grid like grooves 27 are milled into the inner wall up to a depth 28 of about 7 to 10 millimeter. Then the inner wall is preheated to a temperature of about 270 degree centrigrade. This temperature is below the recrystallization temperature of the material, from which the inner wall is produced. An intermediate layer 29 is provided in these grooves having a thickness of about 4 millimeter and this intermediate layer is provided for example by deposit welding. The intermediate layer has the following compositional analysis: 0.02 weight percent carbon, 2.4 weight percent manganese, 0.75 weight percent silicon, 30.0 weight percent copper, 1 weight percent niobium, 1 weight percent iron, 0.25 weight percent titanium, with the remainder being nickel and impurities introduced during melting.

Then the grooves 27 are deposit welded with the wear resistant layer 4, they are cooled and finished by fine milling. The wear resistant layer is of the following composition: 0.9 weight percent carbon, 4 weight percent chromium, 9.5 weight percent molybdenum, 2.2 weight percent tungsten, 2.0 weight percent vanadium, the balance iron and impurities caused by melting.

Figure 6:
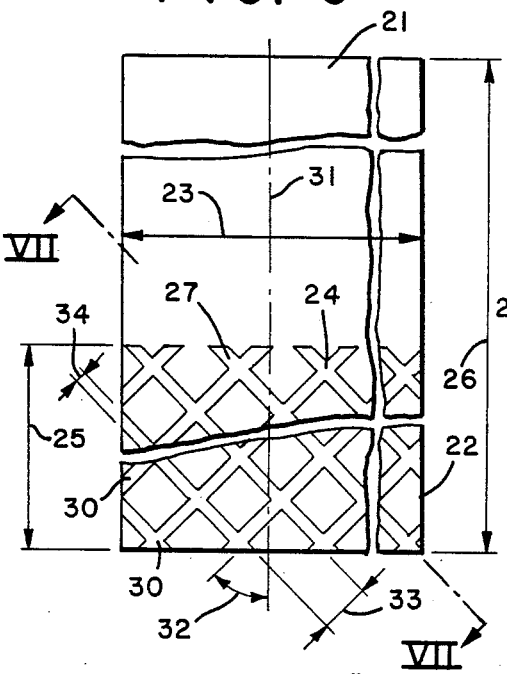
FIG. 6 is a schematic front view of an inner side wall of a continuous casting mold with a wear resistant grid applied.

As can be seen from FIG. 6, the grid rods 30 forming the wear resistant layer are inclined toward the vertical axis 31 of the inner walls at an angle 32 of about 45 degree. The ratio of the distance 13 of two neighboring grid rods 10 to the width 14 of a grid rod 10 amounts to about 4. The width 34 of a grid rod 30 is about 5 millimeter. According to FIG. 6 the regions disposed between the grid rods and made from the base material of the walls, are of rectangular shape.

Figure 8:
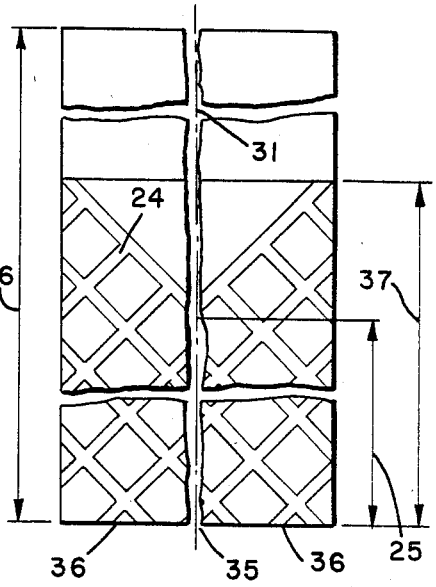
FIG. 8 is a schematic front view of an inner side similar to that of FIG. 6 of a different embodiment.
Figure 7:
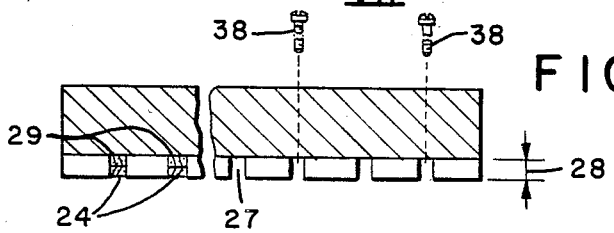
FIG. 7 is a sectional view of the embodiment of FIG. 6 along section line VII—VII of FIG. 2.

The embodiment shown in FIG. 8 distinguishes from the embodiment of FIG. 6 in that the length 25 of the grid shaped wear resistant layer 34 extends to about 150 millimeter in the middle region 35 of the inner wall 21, whereas in the edge regions 36 of the inner wall the wear resistant layer is run over a length 37 of about 300 millimeter.

A particularly advantageous method for the placement of the grid like wear resistant layer can be achieved after the milling out of the grid like disposed grooves 27 by pressing a grid welded from square bars 30 of the wear resistant material into the grooves whereupon the grid is secured from the rear side o the inner walls by way of screws 38.

Figure 9:
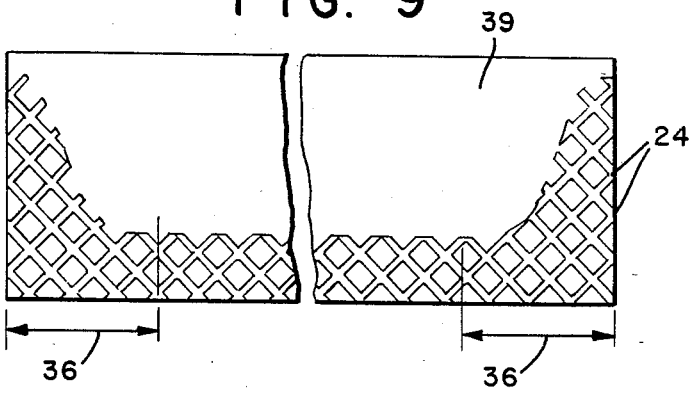
FIG. 9 is a schematic front view of a further embodiment providing a grid of wear resistant material on the inner wall side of a continuous casting mold.

The provision of the grid shaped wear resistant layer 24 in the edge regions 36 of a wide side wall 39 of a plate mold as shown in FIG. 9 allows to avoid furrows and longitudinal scoring, which can be generated upon adjustment of the width of the billet during continuous casting.

The thickness of the wear resistant layer in accordance with the present invention can be considerably larger than taught by the art. The wear and abrasion reistant layer can be at least 2 millimeter thick, preferred thicknesses are 3 millimeter and more preferred are thicknesses of more than 5 millimeter. Such thicknesses allow to still have some wear resistant support as long as the dimensions of the mold are acceptable even though part of the mold has worn off. The disposition of the wear and abrasion resistant material at the output end of the mold and further as an open frame minimizes any interference with the heat transfer but still provides for a much extended life time of such a mold.

The invention can also be implemented for continuous casting molds with billet cross-section, where advantageously all four mold inner walls are provided in the same way with a wear resistant layer, whereas in the case of molds for slabs the application of the resistant layer at the narrow side walls is of first importance. Based on the substantially smaller wear it is possible in the case of slab cross-section to provide the wide side walls without any wear resistant layer.

The deposition usually provided for metallurgical reasons such as for example chromium plating, which serves for the prevention of the pick up of copper by the melt, can in the usual way be provided on the inner walls of the mold after application of the wear resistant layer. This layer extends after the application usually over the full internal walls of the mold, however it is rapidly worked off by the casting shell within a short time.

It will be understood that each of the elements described above, or two or more together, may also find a useful application in other types of casting system configurations and melt freezing procedures differing from the types described above.

While the invention has been illustrated and described as embodied in the context of a continuous mold for a continuous casting plant, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A continuous mold for a continuous casting plant comprising inner walls made from copper and/or an alloy of copper;

a wear resistant layer disposed on the copper and/or alloy of copper on the exposed inner side of the mold and which layer covers at most two fifths of the total surface of a side wall and which reaches from the output end of the continuous mold up to about one third of the length of the mold at the center of the respective side of the mold and which wear resistant layer reaches in the area of the inner edges of the mold from the output end of the continuous mold to at least about the same level as the layer at the center of the respective side and up to the input end of the mold, wherein the wear resistant layer is welded to its support and wherein the wear resistant layer comprises from about 0.1 to 1.5 weight percent carbon, from about 2 to 20 weight percent chromium, from about 0.5 to 15 weight percent molybdenum, up to about 5 weight percent tungsten, up to about 5 weight percent vanadium, and up to about 5 weight percent niobium, with the remainder being iron and impurities resulting from the melting process;

and wherein an intermediate layer disposed between the wear resistant layer and the inner wall and placed on the inner wall of the mold and wherein the intermediate layer comprises from about 1 to 5 weight percent manganese, from about 0.5 to 1.5 weight percent silicon, from about 20 to 50 weight percent copper, up to about 5 weight percent niobium, up to about 5 weight percent iron, up to about 5 weight percent titanium with the balance being nickel as well as impurities caused by the melting step.

2. The continuous mold for a continuous casting plant according to claim 1 wherein the wear resistant layer is formed as a substantially concave curve between from about a semicircle to a U-shape running from the side regions to the middle region of an inner wall.

3. The continuous mold for a continuous casting plant according to claim 1 wherein the wear reistant layer is provided as an open grid on the the inner wall of the continuous mold with the surface areas in the open parts of the net being formed by copper and/or copper alloy.

4. The continuous mold for a continuous casting plant according to claim 1 wherein the wear resistant layer is formed by wear resistant line elements at the wall surface where at least about three fifths of the line elements are inclined relative to the axis of the continuous mold.

5. The continuous mold for a continuous casting plant according to claim 4 wherein the inclination angle of at least two thirds of the wear resistant line elements is from about 30 to 60 degree versus the axis of the continuous mold.

6. The continuous mold for a continuous casting plant according to claim 4 wherein the ratio of the distance between two wear resistant line elements to the surface width of a wear resistant line element is from about 3 to 5.

7. The continuous mold for a continuous casting plant according to claim 1 wherein the surface of the wear resistant layer is not more than one tenth of an inner wall surface of the continuous casting mold.

8. A continuous mold for a continuous casting plant comprising inner walls made from copper and/or an alloy of copper; a wear resistant layer disposed on the copper and/or alloy of copper on the exposed inner side of the mold and which layer covers at most two fifths of the total surface of a side wall and which reaches from the output end of the continuous mold up to about one third of the length of the mold at the center of the respective side of the mold and which wear resistant layer reaches in the area of the inner edges of the mold from the output end of the continuous mold to at least about the same level as the layer at the center of the respective side and up to the input end of the mold; an intermediate layer disposed between the wear resistant layer and the inner wall and placed on the inner wall of the mold by deposit welding and the wear resistant layer being placed on the intermediate layer by deposit welding with a layer thickness of from about 3 to 10 millimeter and where the intermediate layer comprises from about 1 to 5 weight percent manganese, from about 0.5 to 1.5 weight percent silicon, from about 20 to 50 weight percent copper, up to about 5 weight percent niobium, up to about 5 weight percent iorn, up to about 5 weight percent titanium with the balance being nickel as well as impurities caused by the melting step.

9. The continuous mold for a continuous casting plate according to claim 5 wherein the wear resistant layer comprises martensitic steel alloyed with chromium and molybdenum.

10. The continuous mold for a continuous casting plant according to claim 5 wherein the wear resistant layer comprises from about 0.1 to 1.5 weight percent carbon, from about 2 to 20 weight percent chromium, from about 0.5 to 15 weight percent molybdenum, up to about 5 weight percent tungsten, up to about 5 weight percent vanadium, and up to about 5 weight percent niobium, with the remainder being iron and impurities resulting from the melting process.

11. The continuous mold for a continuous casting plant according to claim 8 wherein the grid is provided by parallelepipeds.

12. The continuous mold for a continuous casting plant according to claim 11 wherein the grid is provided by equidistant grid rods disposed at right angles.

13. The continuous mold for a continuous casting plant according to claim 8 wherein the grid is formed by honeycomb sections.

14. The continuous mold for a continuous casting plant according to claim 8 wherein the wear resistant layer is formed by wear resistant line elements at the wall surface where at least about three fifths of the line elements are inclined relative to the axis of the continuous mold.

15. The continuous mold for a continuous casting plant according to claim 14 wherein the inclination angle of at least two thirds of the wear resistant line elements is from about 30 to 60 degree versus the axis of the continuous mold.

16. The continuous mold for a continuous casting plant according to claim 14 wherein the ratio of the distance between two wear resistant line elements to the surface width of a wear resistant line element is from about 3 to 5.

17. The continuous mold for a continuous casting plant according to claim 8 wherein the surface of the wear resistant layer is not more than one tenth of an inner wall surface of the continuous casting mold.

18. The continuous mold for a continuous casting plant according to claim 8 wherein the wear resistant layer is at least 2 millimeter thick.

19. The continuous mold for a continuous casting plant according to claim 18 wherein the wear resistant layer is at least 3 millimeter thick.

20. The continuous mold for a continuous casting plant according to claim 19 wherein the wear resistant layer is at least about 5 millimeter thick.

21. The continuous mold for a continuous casting plant according to claim 8 wherein the wear resistant layer comprises martensitic steel alloyed with chromium and molybdenum.

22. A continuous mold for a continuous casting plant comprising inner walls made from copper and/or an alloy of copper; an intermediate layer disposed and placed on the copper and/or alloy of copper on the exposed inner wall of the mold, wherein the intermediate layer comprises from about 1 to 5 weight percent manganese, from about 0.5 to 1.5 weight percent silicon, from about 20 to 50 weight percent copper, up to about 5 weight percent niobium, up to about 5 weight percent iron, up to about 5 weight percent titanium with the balanced being nickel as well as impurities caused by the melting step;

a wear resistant layer disposed on the intermediate layer on the exposed inner side of the mold and which layer covers at most two fifths of the total surface of a side wall and which reaches from the output end of the continuous mold up to about one third of the length of the mold at the center of the respective side of the mold and which wear resistant layer reaches in the area of the inner edges of the mold from the output end of the continuous mold to at least about the same level as the layer at the center of the respective side and up to the input end of the mold, wherein the wear resistant layer is welded to its support, wherein the wear resistant layer is provided as a grid and wherein the wear resistant layer comprises from about 0.1 to 1.5 weight percent carbon, from about 2 to 20 weight percent chromium, from about 0.5 to 15 weight percent molybdenum, up to about 5 weight percent tungsten, up to about 5 weight percent vanadium, and up to about 5 weight percent niobium, with the remainder being iron and impurities resulting from the melting process.

23. The continuous mold for a continuous casting plant according to claim 22 wherein the grid is provided by parallelepipeds.

24. The continuous mold for a continuous casting plant according to claim 23 wherein the grid is provided by equidistant grid rods disposed at right angles.

25. The continuous mold for a continuous casting plant according to claim 22 wherein the grid is formed by honeycomb sections.

* * * * *